US008616628B2

(12) United States Patent
Beauchamp

(10) Patent No.: US 8,616,628 B2
(45) Date of Patent: Dec. 31, 2013

(54) MULTIPLE CONFIGURATION TABLES AND BARS

(76) Inventor: Francis Beauchamp, Montréal (CA)

( * ) Notice: Subject to any disclaimer, the term of this patent is extended or adjusted under 35 U.S.C. 154(b) by 88 days.

(21) Appl. No.: 13/162,619

(22) Filed: Jun. 17, 2011

(65) Prior Publication Data

US 2011/0309659 A1 Dec. 22, 2011

Related U.S. Application Data

(60) Provisional application No. 61/356,680, filed on Jun. 21, 2010.

(51) Int. Cl.
*A47B 83/02* (2006.01)
*A47C 15/00* (2006.01)

(52) U.S. Cl.
USPC ..... 297/157.1; 297/135; 297/232; 297/257

(58) Field of Classification Search
USPC ..... 297/157.1, 135, 232, 257
See application file for complete search history.

(56) References Cited

U.S. PATENT DOCUMENTS

| | | | | | |
|---|---|---|---|---|---|
| 746,615 | A | * | 12/1903 | Washburn | 186/42 |
| 2,037,815 | A | * | 4/1936 | Ora | 186/49 |
| 2,644,567 | A | * | 7/1953 | Springer | 198/570 |
| 2,745,542 | A | * | 5/1956 | Boots | 198/833 |
| 3,477,760 | A | * | 11/1969 | Bue et al. | 297/158.3 |
| 3,901,355 | A | * | 8/1975 | Shiraishi | 186/44 |
| 4,765,440 | A | * | 8/1988 | Tashman | 186/44 |
| 4,836,114 | A | | 6/1989 | Cohen et al. | |
| 5,160,183 | A | | 11/1992 | Rusyniak | |
| 6,003,944 | A | * | 12/1999 | Glockl | 297/337 |
| 6,375,256 | B1 | * | 4/2002 | Rais | 297/157.1 |

* cited by examiner

*Primary Examiner* — Sarah B McPartlin
(74) *Attorney, Agent, or Firm* — Benoît & Côté

(57) ABSTRACT

There is provided a reconfigurable furniture assembly having a substantially planar surface member movable about a horizontal axis in an endless manner, a support member holding the substantially planar surface over the ground surface, and a plurality of assigned location around the planar surface member for individuals to occupy and face a portion of the planar surface member. A drive element moves the planar surface member and assigned locations about a horizontal axis.

12 Claims, 5 Drawing Sheets

MULTIPLE CONFIGURATION TABLES AND BARS

BACKGROUND (a) Field

The subject matter disclosed generally relates to reconfigurable furniture, and more specifically to reconfigurable tables and bars.

(b) Related Prior Art

The sharing of food at a table is among one of the oldest tradition of the human race. An unfortunate consequence of having large groups of individuals gather to participate in such activities is the difficulty for all participants to communicate with one another around the table. Individuals are normally surrounded by the same participants for the duration of the activity, unless they get up and exchange position. This may lead to a lack of conviviality around the table and in extreme situations it may give rise to frustrating and disappointing experiences when individuals who wanted to entertain a discussion are unable to do so because of the lack of space.

Furniture that may adopt multiple configurations are well known in the art. For example, U.S. Pat. No. 5,160,183 to Rusyniak discloses a combination table and leg rest for a reclining chair, and U.S. Pat. No. 4,836,114 to Cohen et al. discloses a space station wardroom table. In both cases, the furniture articles may be reconfigured to serve multiple purposes such as serving as a foot rest or a table, and fold so as to use less space or accommodate the surfaces to microgravity environment. Also, one of the simplest incarnations of such article of furniture is a table to which one or more panels are added to accommodate a larger number of individuals.

Despite the fact that some of the solutions taught by the prior art allow to accommodate more individuals around the table, they are not facilitating the interactions and communications of all the participants that are taking place around it. Therefore, there is a need for furniture such as tables and bars that help facilitate the interactions and communications of the individuals around it.

SUMMARY

In a first embodiment there is disclosed a reconfigurable furniture assembly which includes at least one substantially planar surface member, movable about a horizontal axis in an endless manner;

at least one support member holding the substantially planar surface member and adapted to engage a ground surface;

a plurality of assigned location, distributed around the substantially planar surface member and arranged to allow an individual to occupy and face an allocated portion of the substantially planar surface member; and at least one drive element, operatively connected to the substantially planar surface member, to the plurality of assigned location, or both, to move the substantially planar surface member, the plurality of assigned location, or both, along the horizontal axis relative to said support member, and when the drive element is operated, the allocated portions of the substantially planar surface member are displaced relative to another allocated portion, and the assigned locations of the plurality of assigned locations are displaced relative to another of the assigned location.

The assigned location may further comprises a seating element, and the seating element may be at least one of a chair, a stool, a sofa, a booth, a bench, a banquette, a tatami, or combinations thereof.

The substantially planar surface member may be a mechanical system, and the mechanical system may be a conveyor system.

The plurality of assigned location may comprise a mechanical system, and mechanical system is a conveyor system.

The substantially planar surface member may be vertically adjustable.

The assigned location may be vertically adjustable.

The seating element may be vertically adjustable.

The position of the seating element relative to the substantially planar surface may be adjustable about a horizontal axis.

The at least one drive element may be a first drive element operatively connected to and adapted to move the substantially planar surface member, and a second drive element operatively connected to and adapted to move the plurality of assigned location.

The reconfigurable furniture may further comprise a stationary central planar surface.

The following terms are defined below.

The term "conveyor system" is intended to mean a piece handling equipment that moves materials from one location to another, useful in applications involving the transportation or materials of any type of weight, but especially heavy or bulky materials. The conveyor system is normally a mechanical system.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

DETAILED DESCRIPTION OF THE PREFERRED EMBODIMENTS

Figure 1:
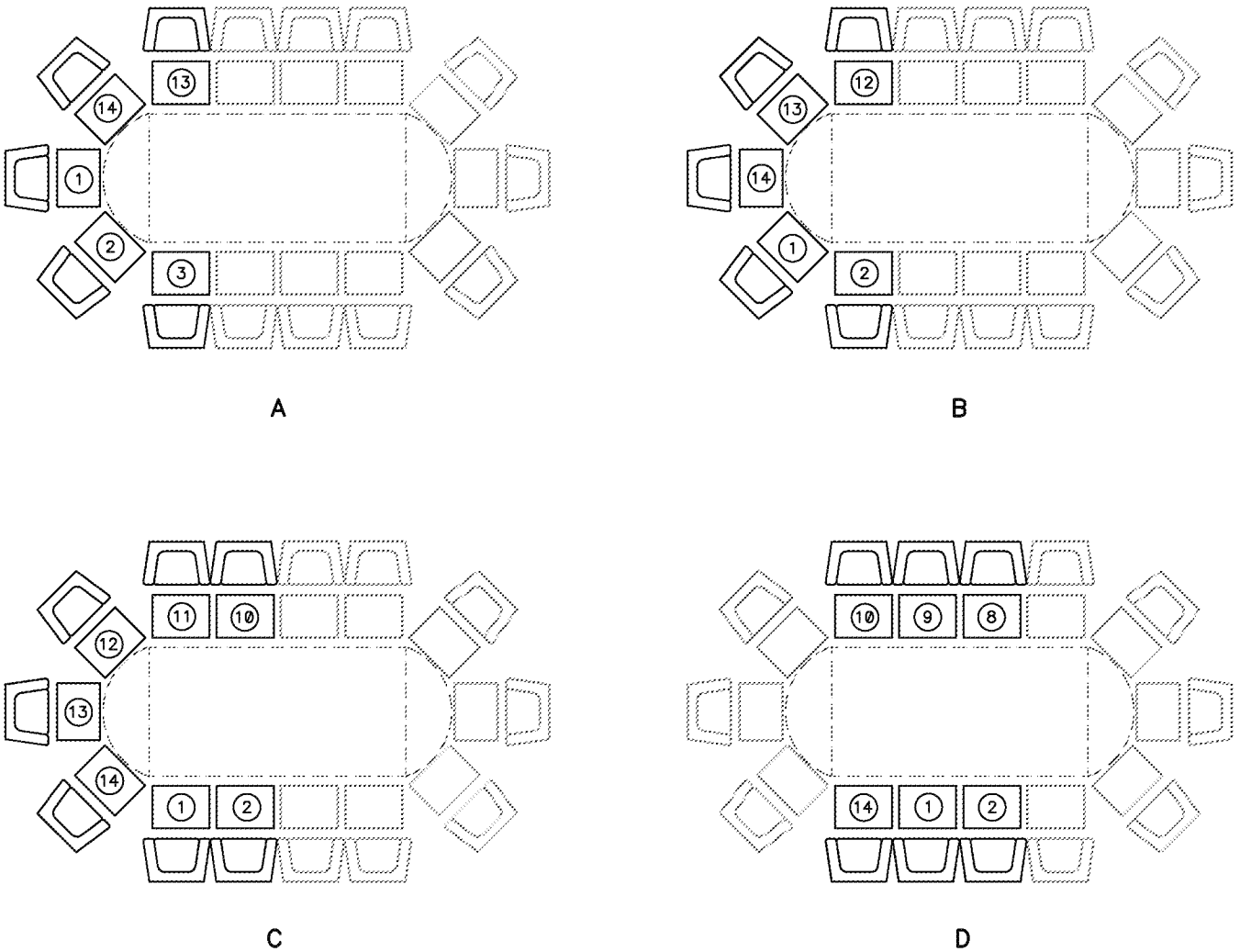
FIG. 1 illustrates the positions and interactions around a furniture assembly according to the present invention.

In embodiments there are disclosed a reconfigurable furniture assembly. The assembly may be used for the fabrication of tables or bars, or other types of surfaces around which one or more individuals may regroup for performing activities such as eating, drinking, working, and playing of games.

The reconfigurable furniture assembly of the present invention comprises one or more substantially planar surface member which is used as table or bar counter, where plates, glasses or any desirable items may be placed upon. A furniture assembly according to the present invention may comprise several substantially planar surface members independently movable about a horizontal axis. Each substantially planar surface may be link to the adjacent substantially planar surfaces. For example, retractable panel could be used to link them. Also, the furniture assembly according to the present invention may comprise a single substantially planar surface member that is shaped, for example, as a regular rectangular table with a single, continuous section (see FIG. 2 for example). The height of substantially planar surface member will vary depending upon the intended use of the furniture assembly, for example, for use as a table, or as a bar. The substantially planar surface member is horizontally movable in an endless manner; that is, a given position on the substantially planar surface member will move horizontally and occupy all the other position until it returns to its original position and begins the cycle anew. The substantially planar surface member will usually move from left to right or vice versa.

The furniture assembly also comprises a plurality of assigned locations that are distributed around the substantially planar surface member. Each assigned location is arranged so that an individual may occupy and face an allocated portion of the substantially planar surface member. The plurality of assigned locations are also movable along the horizontal axis, normally in the same direction as the substantially planar surface member, but not necessarily, as it may be desirable that each of the substantially planar surface member and plurality of assigned location be moving in opposite directions. In usual circumstances, the plurality of assigned locations and the allocated portion of the substantially planar surface member remain one in front of the other, and move in a synchronized manner, such that an individual occupying the assigned location will remain facing the same allocated portion, where items such as plates, glasses may be disposed for use.

To impart motion to the substantially planar surface member and/or plurality of assigned location, the furniture assembly has at least one drive element that is operatively connected to at least one of the substantially planar surface member, the plurality of assigned location or both. The drive element may be a single drive mechanism that is connected to both structures, imparting them with a motion along the same or different directions. In the alternative, each of the substantially planar surface members and/or the plurality of assigned location may be operatively connected to one or more drive element, each driving the structure along the same or different directions. The drive element may be manually operated, so that for example, upon turning of a lever, one could manually move the furniture assembly. The drive element may also be motorized, so as to automatically move the furniture assembly at a controlled pace. The drive element may be incorporated to the flooring of the room comprising the furniture assembly, to hide it and prevent potential injuries to the individuals using the furniture assembly. Preferably, the drive element is quiet or even silent. The drive element may be insulated to prevent any noise it makes. A dedicated control system may be used to specify and adjust the speed in order to control the number of turns the furniture assembly may make every hour, for example. Also, the drive elements should be suitably covered in order to prevent objects from falling in and damaging the drive element. Furthermore, the mechanisms of the drive element may be easily reachable for maintenance.

The furniture assembly also includes at least one support member, such as a pedestal, legs, or any suitable means of supporting the substantially planar surface member over the ground. The support member may also be part of a larger frame in which the substantially planar surface member and/or the plurality of assigned location have been incorporated. The support member is adapted for engaging the ground surface and maintaining the furniture assembly stationary.

The reconfigurable furniture assembly of the present invention may also include seating elements that are disposed, attached or coupled to each of the plurality of assigned location. The seating elements may be at least one of a chair, a stool, a sofa, a booth, a bench, a banquette, a tatami, or combinations thereof. The position of the seating element may be adjusted by fine-tuning either of the individual assigned location and/or the seating element along the vertical axis. It may also be possible to adjust the horizontal position of the seating element relative to the substantially planar surface member to move the seating closer to, further away from, or sideways relative to the substantially planar surface member. In this manner, the height and the distance of an individual from the substantially planar surface member may be adapted to optimize and maximize comfort.

The furniture assembly may be fabricated from any kind of suitable planar material such as wood boards or planks, sheets of plastic or metal, and coupled appropriately to the other components of the invention (i.e. the drive element and/or the support member). The substantially planar surfaces member and/or the plurality of assigned location of the furniture assembly may be sized, shaped and styled as needed or desired.

The furniture assembly may be fabricated from substantially planar surfaces and/or bases made from a conveyor system. The furniture assembly may be fabricated from one elongated conveyor for each of the substantially planar surface member and the plurality of assigned location (see FIG. 2). A single conveyor system may be used to fabricate the furniture assembly, so that each of the substantially planar surface member and the plurality of assigned location are located upon it and move in a coordinated manner (see FIGS. 3-5).

The furniture assembly may also include a central region 22 between the rows of seats 28 facing each other an empty space or a stationary central planar surface, where items may be placed and reached for by the individuals surrounding the furniture assembly. The distance D between the rows of seats 28 may be optimized to allow individuals to have a proper conversation.

In use, the furniture assembly of the present invention allows individuals to stand up or be seated around a table or bar, and move them and the items in front of them around the periphery of the furniture assembly. Also, the flooring of the location where the furniture assembly is kept and used should be sufficiently strong to support it, depending on the weight of the furniture assembly.

Alternative Embodiments

Example I

A furniture assembly is fabricated from a circular substantially planar surfaces member, and 2 or more assigned locations are adapted to receiving two or more individuals. These individuals are rotated around while seated or standing, which provides them with an ever changing view of their surroundings.

Example II

Figure 2:
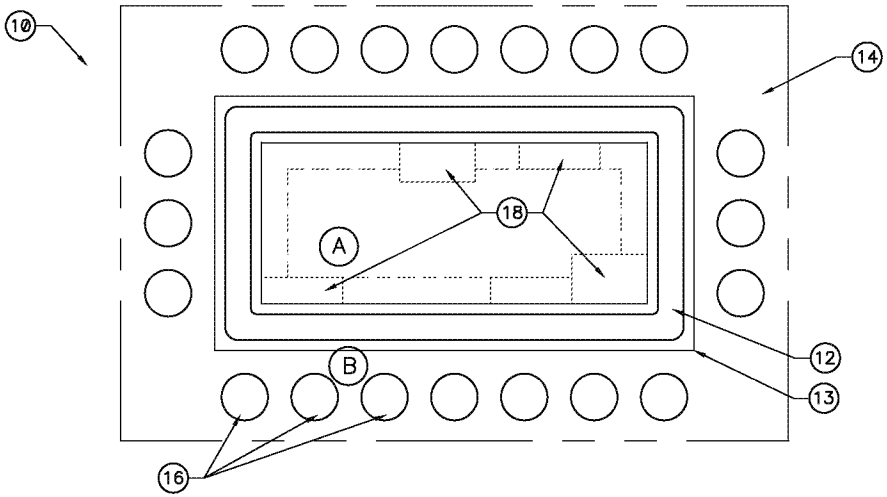
FIG. 2 illustrates a bar according to one embodiment of the present invention.

As shown in FIG. 2, a furniture assembly 10 is fabricated in the shape of a square or rectangular bar with corners, where the counter top 12 (the substantially planar surfaces member) is an elongated conveyor system. The counter top 12 may be surrounded by a fixed counter 13. A second elongated conveyor system 14 is disposed on the floor on the patron side of the bar B, with some sections comprising stools or high chairs 16, while other sections do not comprise any seating (the plurality of assigned locations). On the inside there is a barman section A with equipment 18. The patrons standing or seating at the bar will experience an ever changing company and view as their relative position around the bar changes. Furthermore, the patrons will travel at the same pace as any of the belongings or drinks that have been placed in front of them on the counter top conveyor 12 and conveyor 14 are moving in a synchronized manner.

Example III

Figure 3:
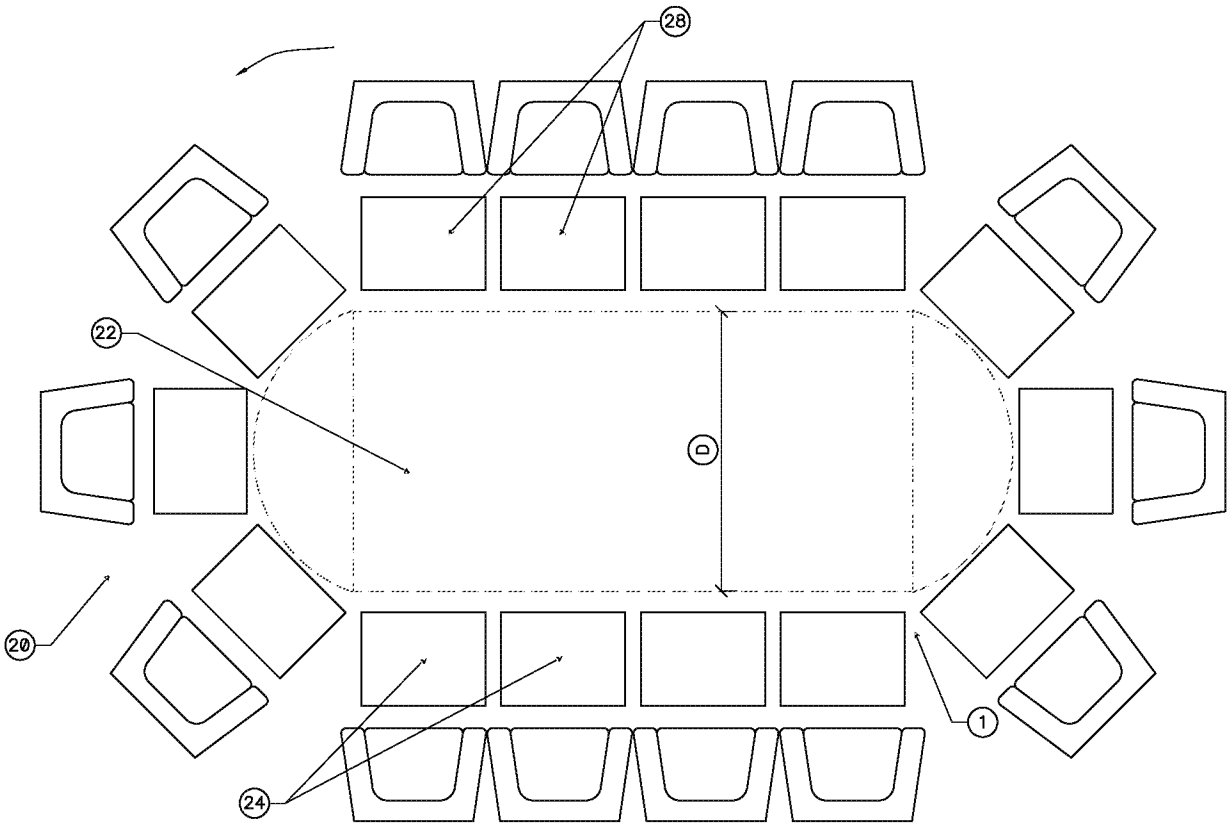
FIG. 3 illustrates a table according to an embodiment of the present invention.
Figures 4A, 4B, 4C, 4D:
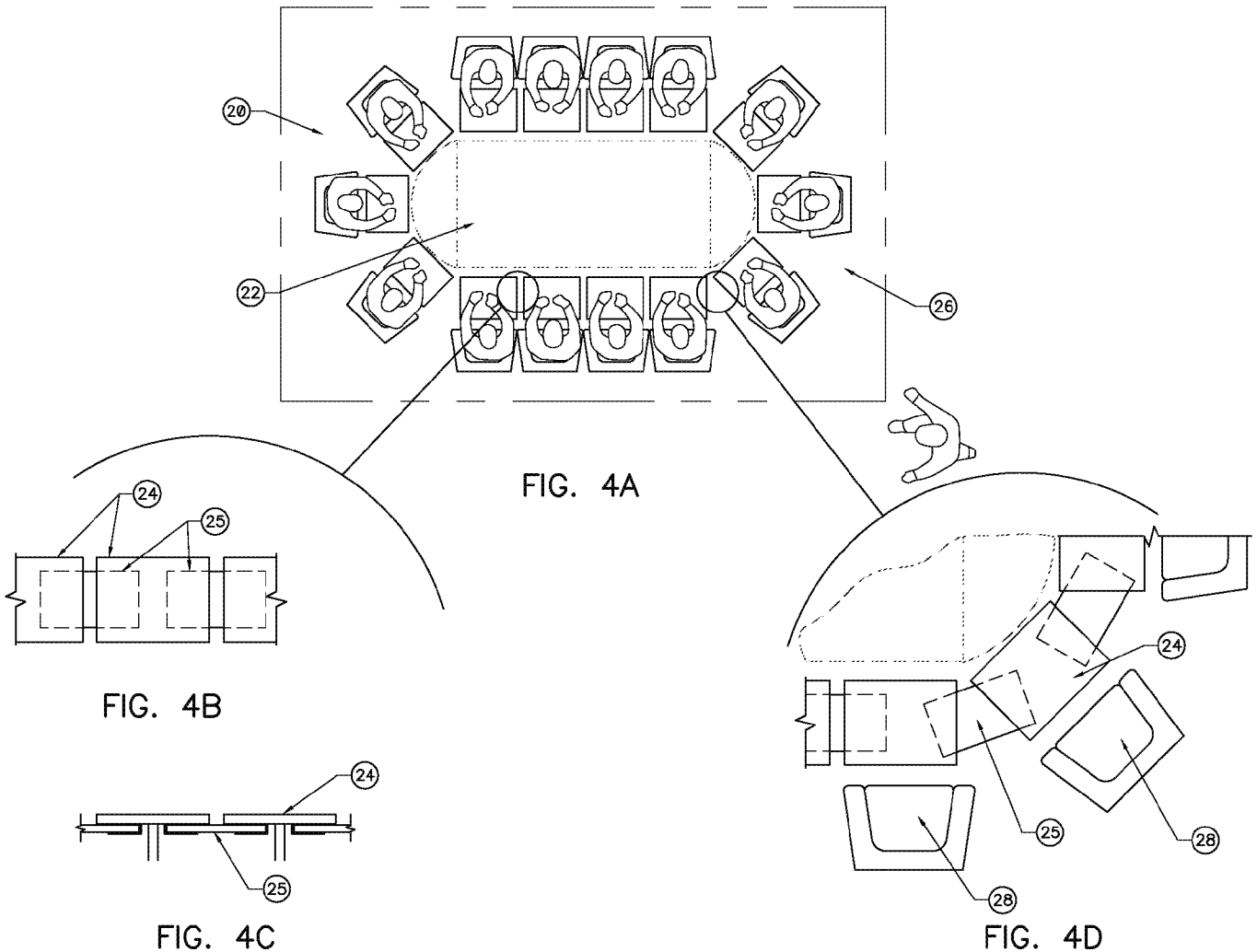
FIG. 4A is a plan view of a table according to an embodiment of the present invention.
FIG. 4B is a plan view of a table section and an under table section according to an embodiment of the present invention.
FIG. 4C is section view of a table section and an under table section according to an embodiment of the present invention.
FIG. 4D is a plan view of a table section and an under table section according to an embodiment of the present invention.
Figure 5:
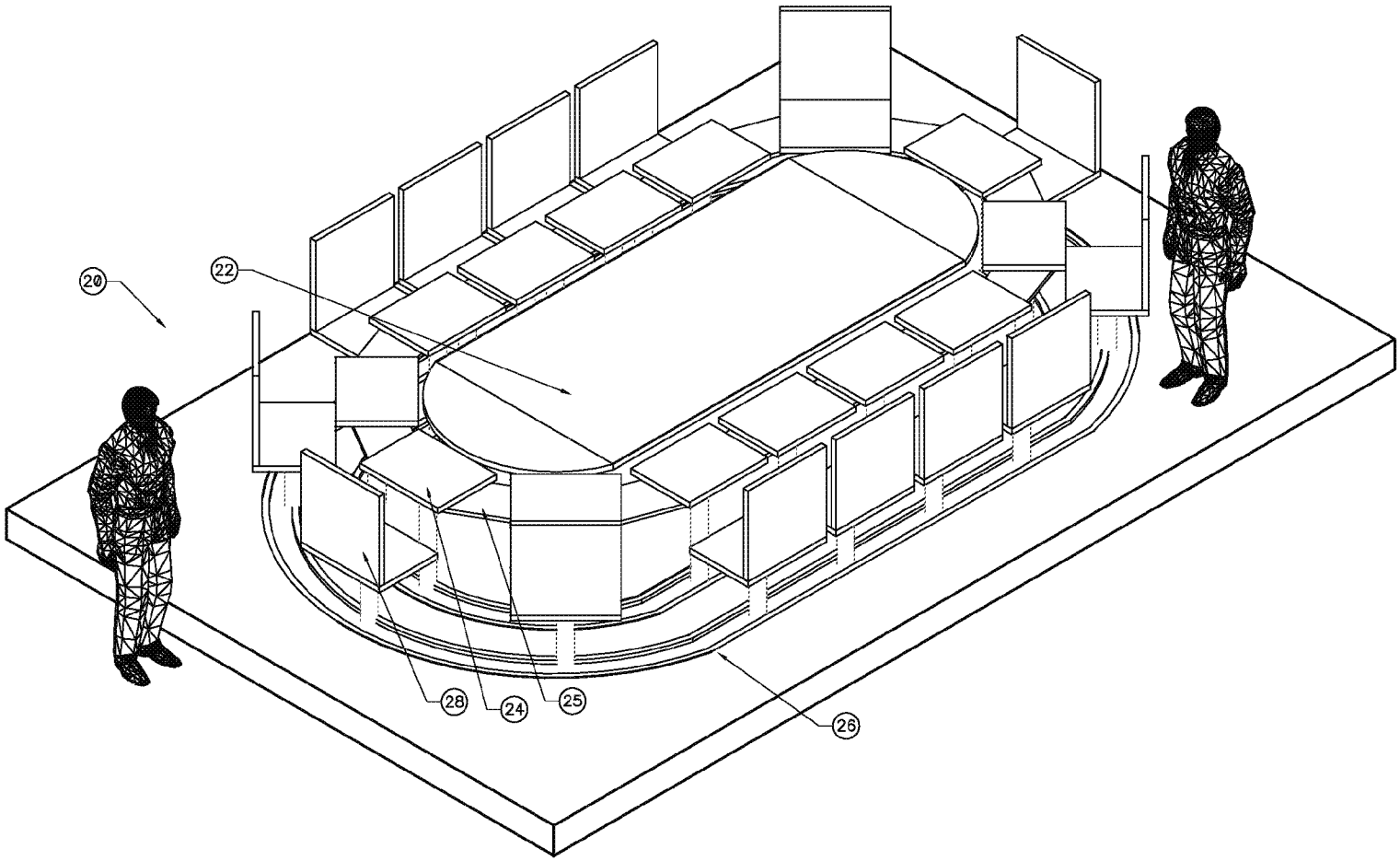
FIG. 5 is an isometric view of a table section and an under table section according to an embodiment of the present invention.

As shown in FIGS. 3-5, a furniture assembly is fabricated in the shape of an elongated oval dinner table 20 with separate sections of table 24. The central region 22 of the dinner table may be an empty space or may be a planar surface held stationary relative to outside portion of the furniture assembly which is comprised of individual table sections 24 and chairs 28. While the table sections 24 are rotating relative to one another, their corners 1 do not touch each other directly. The table sections 24 provide sufficient space between each other so as to prevent injury of the seated individuals during movement. Dishes, platters or bottles may be disposed on the stationary central platform for anyone to grab. On the single elongated conveyor system 26, individual table sections 24 and chairs 28 are attached thereto and rotate about the central region 22 to allow the guests to sit in and enjoy a diner. The table sections 24 may be joined by retractable and movable panels 25, that may follow the motion of the table sections 24 around the central region 22 (See FIGS. 4B-C and 5). The guests will experience an ever changing company and view (see FIG. 1A-D) as their relative position around the table changes.

The embodiments and examples presented herein are illustrative of the general nature of the subject matter claimed and are not limiting. It will be understood by those skilled in the art how these embodiments can be readily modified and/or adapted for various applications and in various ways without departing from the spirit and scope of the subject matter disclosed and claimed. The claims hereof are to be understood to include without limitation all alternative embodiments and equivalents of the subject matter hereof. Phrases, words and terms employed herein are illustrative and are not limiting. Where permissible by law, all references cited herein are incorporated by reference in their entirety. It will be appreciated that any aspects of the different embodiments disclosed herein may be combined in a range of possible alternative embodiments, and alternative combinations of features, all of which varied combinations of features are to be understood to form a part of the subject matter claimed.

The invention claimed is:

1. A reconfigurable furniture assembly comprising:

a substantially planar surface member;

a first conveyor system provided around said substantially planar surface member, the first conveyor defining a horizontal surface;

a plurality of seating elements positioned and supported on said horizontal surface;

a plurality of assigned locations provided on the first conveyor system for receiving the plurality of seating elements thereon, wherein the assigned locations are configured to allow a first occupant of a first seating element to face a second occupant of a second seating element;

a first drive element operatively connected to the first conveyor system for rotating the assigned locations around the substantially planar surface member such that the first occupant faces occupants other than the second occupant as the first conveyor system rotates.

2. The reconfigurable furniture assembly of claim 1, wherein a first distance between adjacent seating elements is adjustable.

3. The reconfigurable furniture assembly of claim 1, wherein a second distance between a given seating element and the substantially planar surface member is adjustable.

4. The reconfigurable furniture assembly of claim 1, further comprising a plurality of allocated portions provided on the substantially planar surface member, the plurality of allocated portions being operably connected to the first drive element for rotating synchronously with the seating elements.

5. The reconfigurable furniture assembly of claim 4, wherein the allocated portions rotate in the same direction of the seating elements.

6. The reconfigurable furniture assembly of claim 4, wherein the allocated portions rotate in an opposite direction of the seating elements.

7. The reconfigurable furniture assembly of claim 1, wherein an outer periphery of the first conveyor system is larger than and surrounds an outer periphery of the substantially planar surface member.

8. The reconfigurable furniture assembly as claimed in claim 1, wherein the seating elements are selected from the group consisting of: chairs, stools, sofas, booths, benches, banquettes, tatamis, or combinations thereof.

9. The reconfigurable furniture assembly as claimed in claim 1, wherein the seating elements are vertically adjustable.

10. The reconfigurable furniture assembly as claimed in claim 1, wherein the substantially planar surface member is vertically adjustable.

11. The reconfigurable furniture assembly of claim 1, further comprising a plurality of allocated portions provided on the substantially planar surface member, the plurality of allocated portions being provided on a second conveyor system adapted to rotate the plurality allocated portions synchronously with the seating elements.

12. The reconfigurable furniture assembly of claim 11, wherein the second conveyor system is operably connected to a second drive element other than the first drive element.

* * * * *